US009677571B2

(12) United States Patent
Pfannenberg

(10) Patent No.: US 9,677,571 B2
(45) Date of Patent: Jun. 13, 2017

(54) DEVICE FOR THE PASSAGE OF AIR

(75) Inventor: Andreas Pfannenberg, Hamburg (DE)

(73) Assignee: PFANNENBERG GMBH, Hamburg (DE)

( * ) Notice: Subject to any disclaimer, the term of this patent is extended or adjusted under 35 U.S.C. 154(b) by 753 days.

(21) Appl. No.: 11/899,610

(22) Filed: Sep. 6, 2007

(65) Prior Publication Data

US 2008/0160898 A1 Jul. 3, 2008

(30) Foreign Application Priority Data

Dec. 27, 2006 (DE) ..... 20 2006 019 690 U
Dec. 27, 2006 (DE) ..... 20 2006 019 691 U

(51) Int. Cl.

| | |
|---|---|
| ***H05K 5/02*** | (2006.01) |
| ***F04D 29/70*** | (2006.01) |
| ***F04D 25/12*** | (2006.01) |
| ***F04D 29/54*** | (2006.01) |

(52) U.S. Cl.
CPC ..... *F04D 29/703* (2013.01); *F04D 25/12* (2013.01); *F04D 29/547* (2013.01)

(58) Field of Classification Search
CPC ..... F04D 25/12; F04D 7/20; F04D 7/20136; F04D 7/20009; F04D 7/20172; F04D 7/20536; H05K 9/0041
USPC ..... 361/695; 454/184, 264, 208, 187, 284, 454/255, 338; 415/119, 191, 222
See application file for complete search history.

(56) References Cited

U.S. PATENT DOCUMENTS

| | | | | |
|---|---|---|---|---|
| 3,204,546 | A * | 9/1965 | Krell | 454/272 |
| 4,087,197 | A | 5/1978 | Haugen | |
| 4,167,376 | A * | 9/1979 | Papst | 417/354 |
| 4,221,546 | A * | 9/1980 | Papst et al. | 417/354 |
| 4,724,747 | A * | 2/1988 | Sturm et al. | 454/184 |
| 5,460,571 | A * | 10/1995 | Kato et al. | 454/184 |
| 5,520,513 | A * | 5/1996 | Kuroki et al. | 415/223 |
| 5,695,318 | A * | 12/1997 | Harmsen | 415/218.1 |
| 6,110,245 | A * | 8/2000 | Schlag et al. | 55/385.6 |
| 6,254,343 | B1 * | 7/2001 | Schmidt et al. | 415/222 |
| 6,398,492 | B1 * | 6/2002 | Cho et al. | 415/191 |
| 6,450,760 | B1 * | 9/2002 | Furukawa et al. | 415/119 |
| 6,585,489 | B2 * | 7/2003 | Perella | F04D 29/703 416/247 R |

(Continued)

FOREIGN PATENT DOCUMENTS

| | | |
|---|---|---|
| DE | 3230511 A1 | 2/1984 |
| DE | 4013645 A1 | 5/1991 |
| DE | 195 36 928 | 1/1997 |

(Continued)

*Primary Examiner* — Steven B McAllister
*Assistant Examiner* — Ko-Wei Lin
(74) *Attorney, Agent, or Firm* — Lucas & Mercanti, LLP; Klaus P. Stoffel

(57) ABSTRACT

A filter fan, with a blower, for fitting in a mounting opening in a wall. The filter fan has a basic casing, a design cover. An aeration grid with lamellar elements is held on the opposed side walls of the design cover and a filter mat is placed between the basic casing and the fan grid. A grid element is placed on the air outlet side of the filter fan for the passage of air above an air outlet. The grid element has an ascending section and a planar section, whereby the ascending section changes into the planar section and a full surface section is provided on the planar section.

9 Claims, 8 Drawing Sheets

(56) References Cited

U.S. PATENT DOCUMENTS

| | | | | |
|---|---|---|---|---|
| 2006/0147304 | A1* | 7/2006 | Cho et al. | 415/191 |
| 2007/0125593 | A1* | 6/2007 | Hashizume | 181/225 |

FOREIGN PATENT DOCUMENTS

| | | | | |
|---|---|---|---|---|
| DE | 200 16 143 | | 11/2000 | |
| DE | 20016143 | U1 * | 11/2000 | F24F 13/085 |
| DE | 20200401107 | U1 * | 2/2004 | |
| DE | 202004000994 | * | 5/2004 | F04D 27/001 |
| DE | 202004000994 | U1 * | 6/2004 | |
| EP | 1098692 | B1 | 5/2001 | |
| FR | 1 371 399 | | 9/1964 | |
| FR | 2323042 | A1 | 4/1977 | |
| SU | 375863 | A3 | 3/1973 | |
| SU | 591619 | A1 | 2/1978 | |

* cited by examiner

DEVICE FOR THE PASSAGE OF AIR

BACKGROUND OF THE INVENTION

1. Field of the Invention

The present invention relates to a device for the passage of air, in particular to a filter fan or outlet filter.

2. Description of the Related Art

For components placed in a casing which produce waste heat, it is necessary to carry away the waste heat form the casing and to control a temperature in the casing by more or less strong blowing in or sucking off of ambient air into the casing inner space by means of a fan. Computer casings are a known example for this, whereby the guiding principle is that the more cooling the better. Usually such casings are provided with a filter fan which either is continually running or which is switched on and off by a control device depending on a temperature in the casing. The filter fan is placed in a recess of a wall of the casing and fixed for example by means of screwed connections. Simultaneously corresponding air outlet slits are provided at another place of the casing for the air outlet.

Because of the electrostatic charging of the electronic structural members and components which are placed in the inside of the casing, dirt and dust particles accumulate thereon so that there can be dysfunctions of the components. In order to avoid dirt accumulation, it is known to provide in the fan an additional filter mat preferably of a knitted or needled synthetic material in order to filter out these dust and dirt particles from the air which is conveyed through the fan in a flow direction. For this purpose, a filter mat is preferably placed in flow direction of the air before the blast of the fan, whereby an intermediate space between the filter mat and the blast is closed substantially air tight against the ambient air by a basic casing and a blast support. The filter mats used for these filter fans are placed between the outer filter grid and the basic casing. The fan grid is removably connected with the basic casing by means of clamping or snap-in connections or screwed connections.

The air outlet of the device for the passage of air is covered for known fans with a grid element which either covers the outlet plainly, or shell-shaped. The air which comes out of the air outlet through the grid element into the casing moves axially or in flow direction and straight into the casing. The air must then distribute itself or an active air distribution has to take place. It is aimed at that an active air distribution can be avoided or that the air distributes itself better. Furthermore, it is possible that parts of the outcoming air flow in particular in the middle are sucked again into the passage.

SUMMARY OF THE INVENTION

The aim of this invention is to configure a device for the passage of air according to the type described in the introduction so that the air coming out of the device for the passage of air is delivered into the casing in several directions and that a sucking back of air is avoided.

This aim is achieved for a device for the passage of air in that a grid element is placed on the air outlet side of the device for the passage of air above an air outlet, this grid element having an ascending section and a planar section, whereby the ascending section changes into the planar section and a full surface section is provided on the planar section.

It is advantageous that due to the construction of the grid element the outflowing air is delivered through the ascending section principally in the lateral area of the grid, thus rather radially so that a better mixing inside the casing is obtained.

This is supported by the full surface section which acts as an obstacle for the flow. Simultaneously, the built-in depth is reduced compared with traditional oval grid elements. The full surface section simultaneously acts as a retaining element which avoids the backflow of air into the casing.

A further configuration according to the invention provides that the blast support is provided with a side wall and with a recess for a blast, preferably made of a rotor, preferably made of wings, or of a rotor and a drive, whereby the blast support has on the side of the grid element a section configured in the art of a diffuser which is preferably a constituent of the side wall or which is made in one piece with the side wall and the section opposite the side wall is deflected about an inner angle ($\alpha$) which is situated between 180° and 270°, which is particularly preferably 290°, and whereby the grid element has an ascending or a descending section and a planar section, whereby the ascending or the descending section changes into the planar section and a full surface section is provided on the planar section.

Besides the above mentioned advantages, it is additionally achieved with this configuration that an increase of performance of the air output is achieved by avoiding the backflow. This increase is situated in the range of up to 10%. Moreover, it is advantageous that an air outlet as resistance-less as possible can take place due to the diffuser-type construction of the exhaust air side. Only slight pressure losses do occur.

Advantageous configurations of the invention are the subject of the subclaims.

Due to the shaping of the diffuser-type section, a particularly efficient air delivery is made possible. The displacement of the stud point to the middle causes a reduction of the free delivery surface so that the back suction area is further reduced. The providing of a soft transition from the side wall to the diffuser-type section causes less resistance and thus less flow losses at the transition into the diffuser-type section, whereby even a resistance-free air outlet can be realized.

Due to the closing arrangement of the grid element, a protective cover of the device for the passage of air is achieved in a simple manner.

According to a further teaching of the invention, due to the linear increasing, a radial outlet of the air through the grid element is improved in a simple manner. The central arrangement of the planar section advantageously makes possible a straight delivery of the air in axial direction through the grid element in spite of providing ascending sections.

The providing of a full surface section in the middle makes possible a simple deflection of a part of the air flow flowing through the device for the passage of air into a radial direction. A providing of a small full surface section opposite the planar section makes possible an air flow part axially out of the device for the passage of air. Due to the providing of a disk-shaped plate body and to the placing thereof on the grid element or to its integration into the grid element, the distribution of the air flow can be achieved in a simple manner. The parallel arrangement of the planar section to the air outlet supports the distribution of the air flow in a simple manner.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
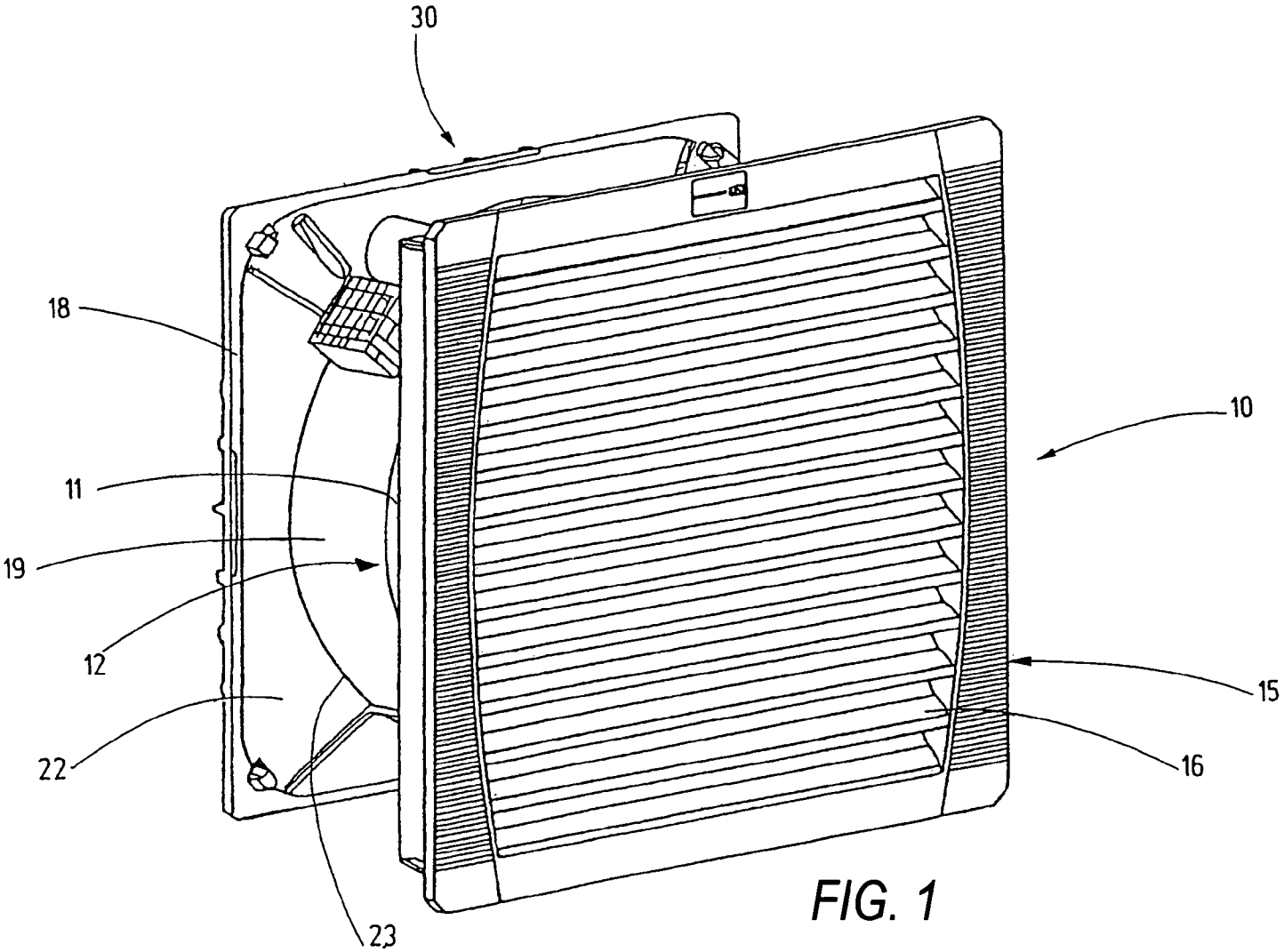
FIG. 1 is a perspective front view of the device for the passage of air.

A device for the passage of air 10 is represented in a front view in FIG. 1. On the front side which is situated outside of a casing to be ventilated (not represented), a so-called design cover 15 is provided through which air is sucked into the device for the passage of air 10 through a blast 20 (see FIG. 5). The design cover 15 is provided with movable lamellar elements 16. The design cover 15 is placed on a basic casing 11 which is followed by a blast support 12. The blast 20 is placed inside the blast support 12. The blast support has a side wall 19. A diffuser area 22 is placed in the rear area of the side wall 19. This area 22 is U-bent opposite the side wall 19 after a transition area 22. A rear wall 18 on which a grid element 30 is placed is placed on the blast support 12 or in the diffuser area 22.

Figure 2:
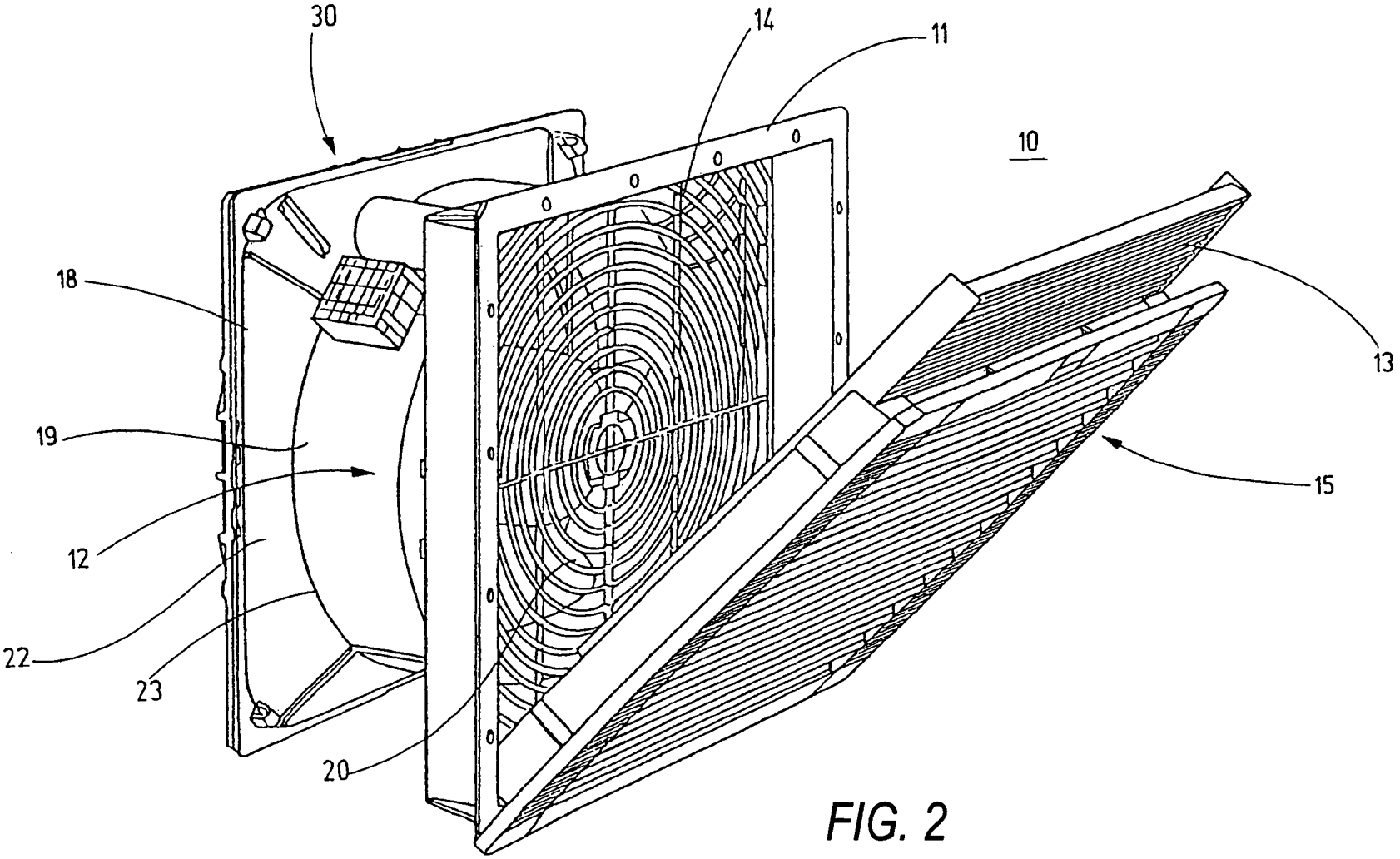
FIG. 2 is a perspective front view of the device for the passage of air with an opened front flap.

The device for the passage of air 10 in FIG. 2 is represented with an opened design cover 15. A filter mat 13 which filters dust out of the sucked air is placed behind the design cover 15. A grid element 14 is placed behind the filter mat 13. This element acts as a blast grid and protects the blast 20 against a grasping-in when, for example, the filter mat 13 is replaced.

Figure 3:
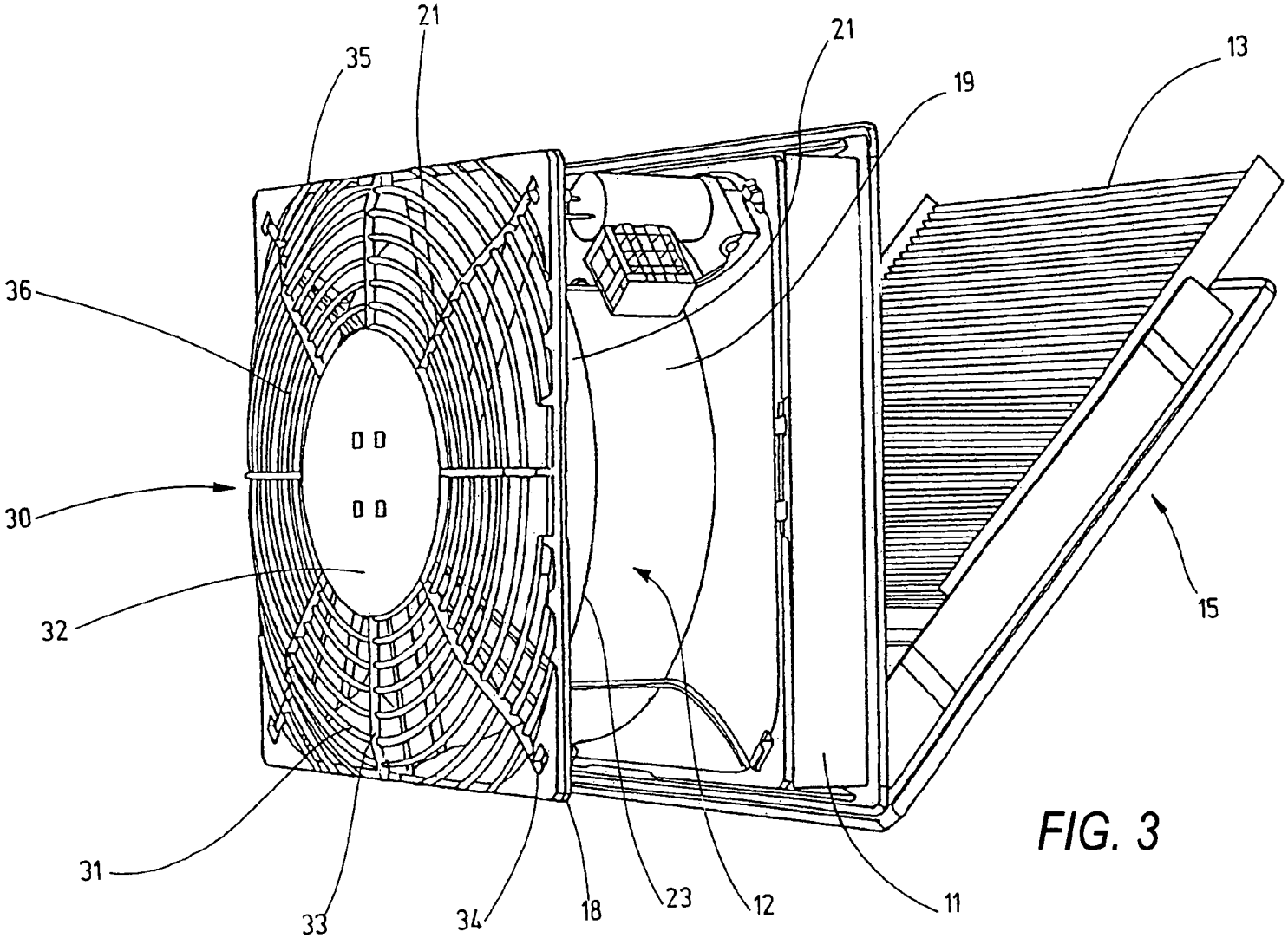
FIG. 3 is a perspective rear view of the device for the passage of air with an opened front flap.
Figure 4:
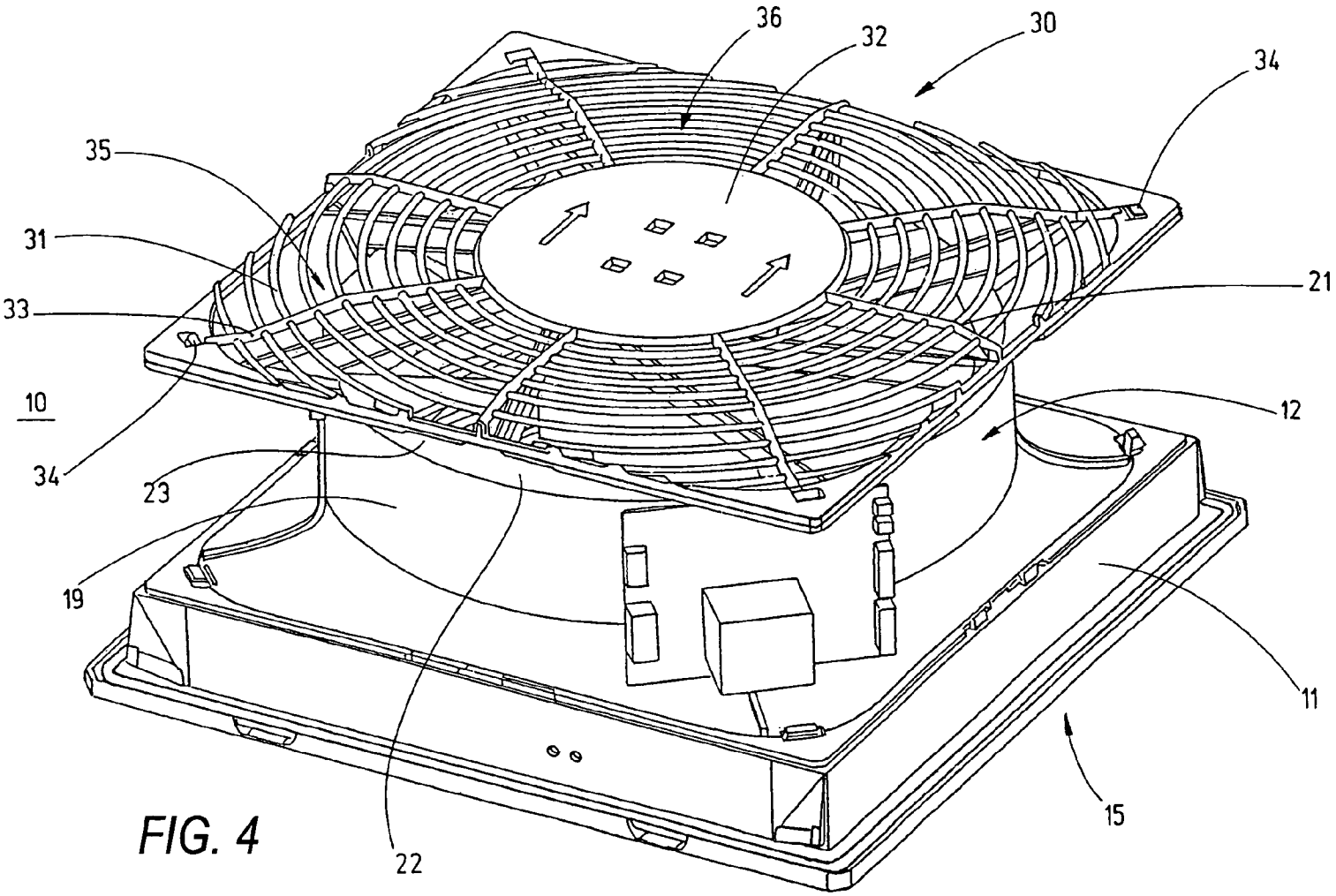
FIG. 4 is a perspective top view of the rear side of the device for the passage of air.

A grid element 30 which is connected with the rear wall by fixing sections 34 is placed on the rear wall 18 (FIG. 3). An area protected with a grid which consists of an ascending area 35 and of a planar area 36 is situated in the open rear side area 21 through which the air sucked by the blast 20 comes out. The grid element 30 here is made of annular grid rods 31 and supporting webs 33. A plate element 32 is placed in the middle of the planar area 36, this plate element being acting as a flow resistance and thus as a deflection element for the outcoming air. FIG. 4 shows a rear view similar to FIG. 3 with a closed design cover.

Figure 5:
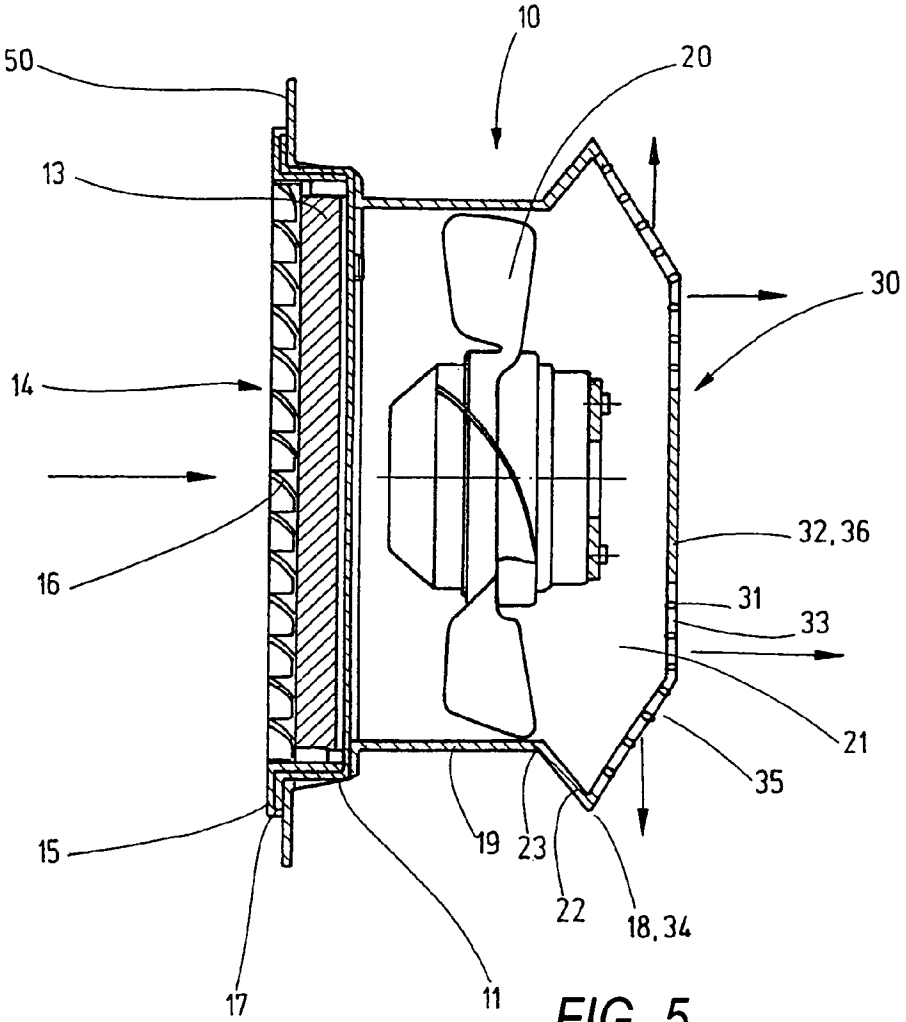
FIG. 5 is a sectional side view of the device for the passage of air.

In FIG. 5, the device for the passage of air 10 is represented in the mounted state in a mounting wall 50. A gasket 17 is placed between the mounting wall 50 and the basic casing 11, whereby this gasket guarantees that no air can penetrate in the transition area between the mounting wall and the device for the passage of air.

Figure 6:
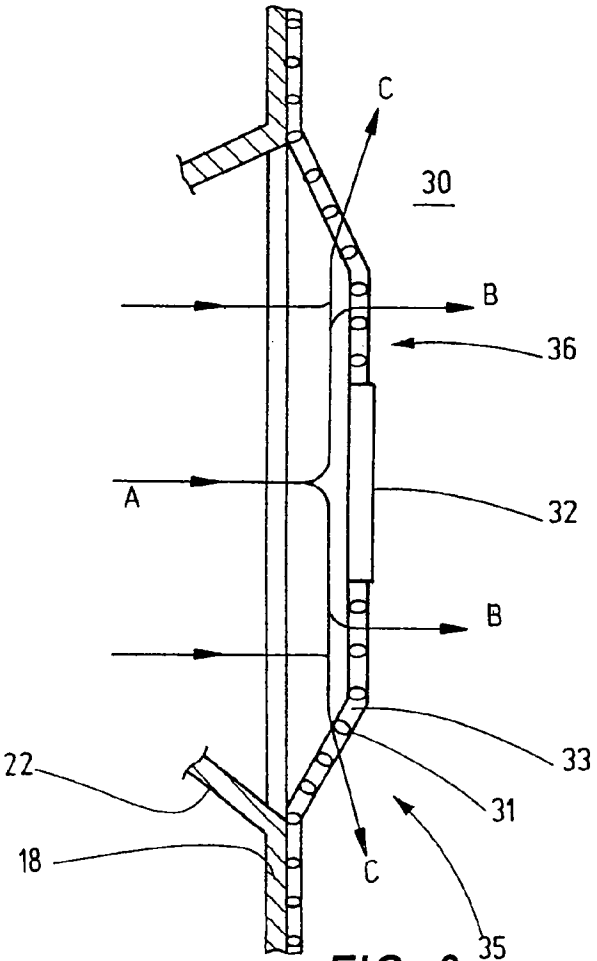
FIG. 6 is a sectional view of the grid element section of FIG. 5.

An enlarged representation of the grid element 30 is represented in FIG. 6. The sucked air moves in the area A onto the grid element 30. The air which comes onto the plate element 32 is deflected to the side. Thus, the air flow is divided into an axial component B and a radial component C. The axial component B comes out through the planar section 36 of the grid element. The radial component C comes out through the ascending section 35. In this manner, the air is distributed director and simpler inside the casing to be ventilated (not represented). Additional guiding elements or the like can be provided. Simultaneously, the air can pass more quickly through the grid element 30 so that an increase of the air throughput is caused in the blast 20 which also means a power increase. Due to the lateral delivery of the air, a new suction In the area of the plate element 32 is fundamentally reduced. Furthermore, the providing of the plate element 32 prevents a back flow of the air into the device for the passage of air 10.

Figure 7:
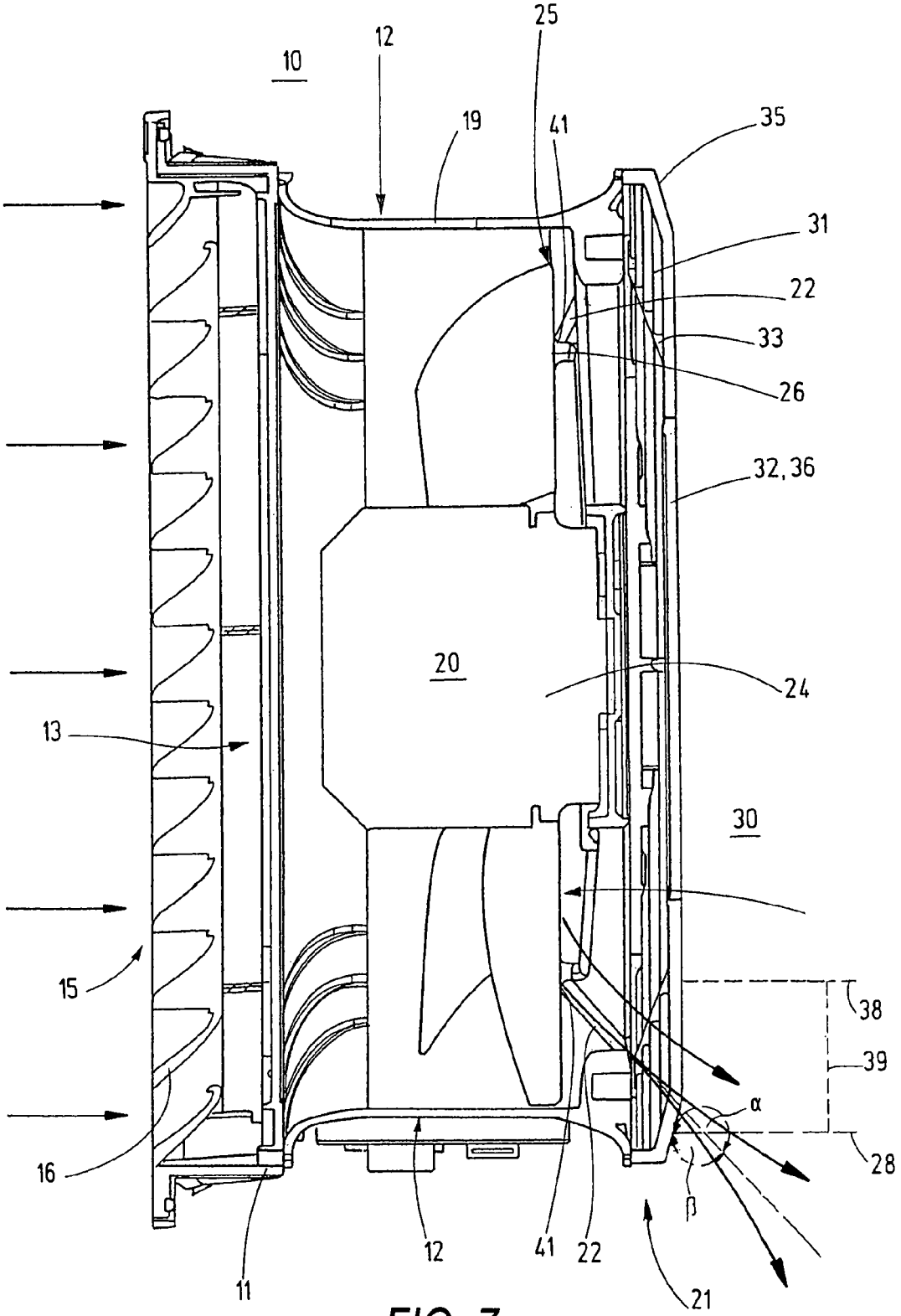
FIG. 7 is a partial sectional side view of an embodiment of the device for the passage of air.

In FIG. 7, the blast support 12 is represented cut in a first embodiment. A blast 20 is placed inside the blast support 12. The blast 20 is made of a rotor with wings 27 and a drive 24 as a motor. The wing 27 has a tip 25 and a rear edge 26. The blast support 12 is made among others of the side wall 19 and the diffuser area 22. A first embodiment of the arrangement of the diffuser area 22 is shown in FIG. 7. A further embodiment follows in FIG. 9.

Figure 8:
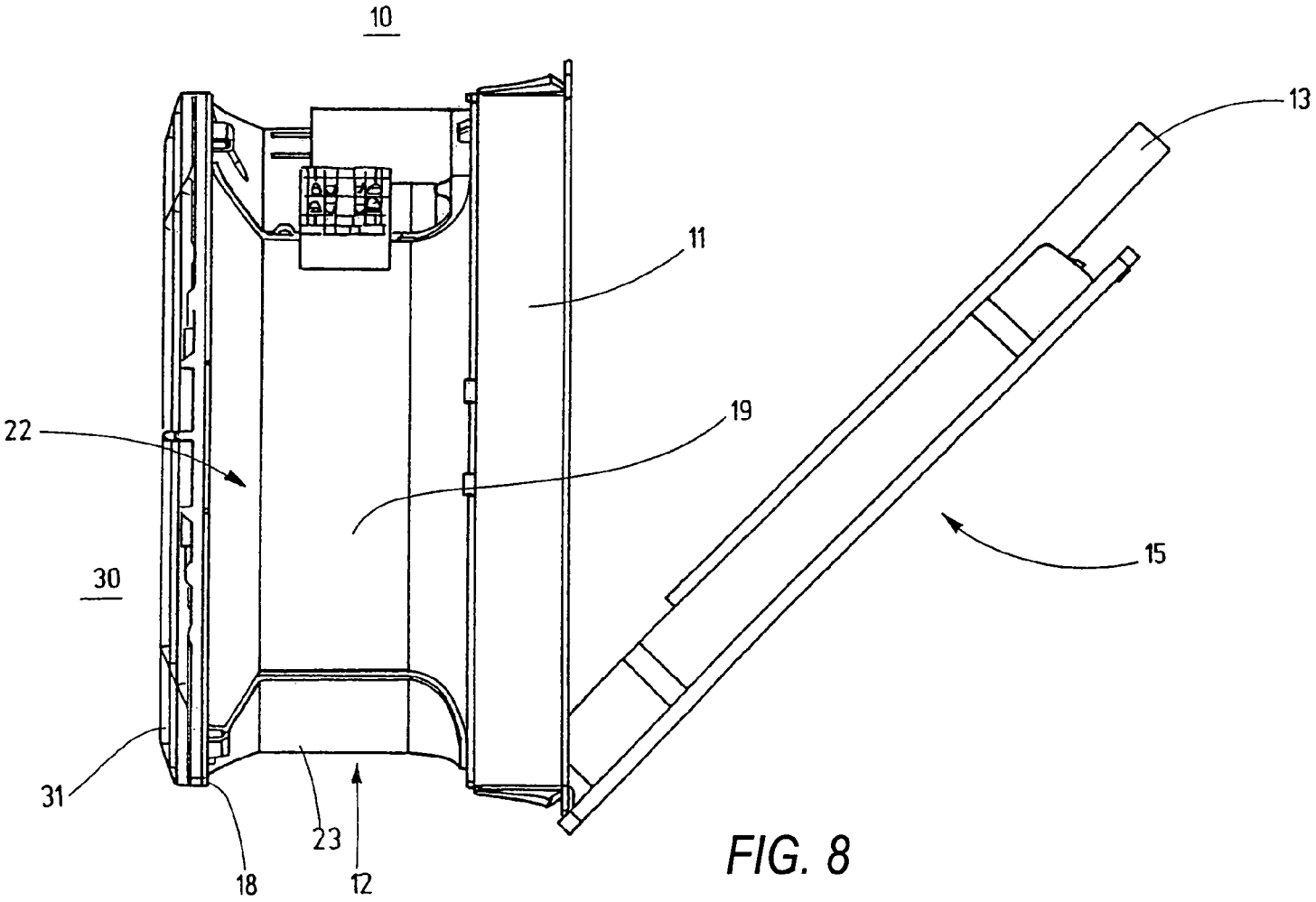
FIG. 8 is a side view of the device for the passage of air with a closed front flap.

The diffuser area 22 is connected with the side wall 19. However, the connection is made in the end area of the blast area of the blast support 12 in the rear area 21 of the device for the passage of air 10. The diffuser area 22 is configured inclined opposite the side wall 19. The inclination is made opposite the side wall about an exterior angle $\beta$ and an internal angle $\alpha$. The angles between the extension 28 of the side wall 19 and the extension 29 of the diffuser area 22 are represented in FIG. 7. The stud point 41 of the diffuser area 22 opposite the blast 20 is offset to the blast drive 24. The offset 39 is represented in FIG. 7 between the extension 28 of the side wall 19 and the parallel 38 starting from the stud point of the diffuser area 22 for extending the side wall 28. The stud point of the diffuser area 41 is situated directly behind the rear edge 26 of the wings 27. FIG. 8 shows a side view of FIG. 7 with the blast support 12 represented closed and with the design cover 15 opened.

Figure 9:
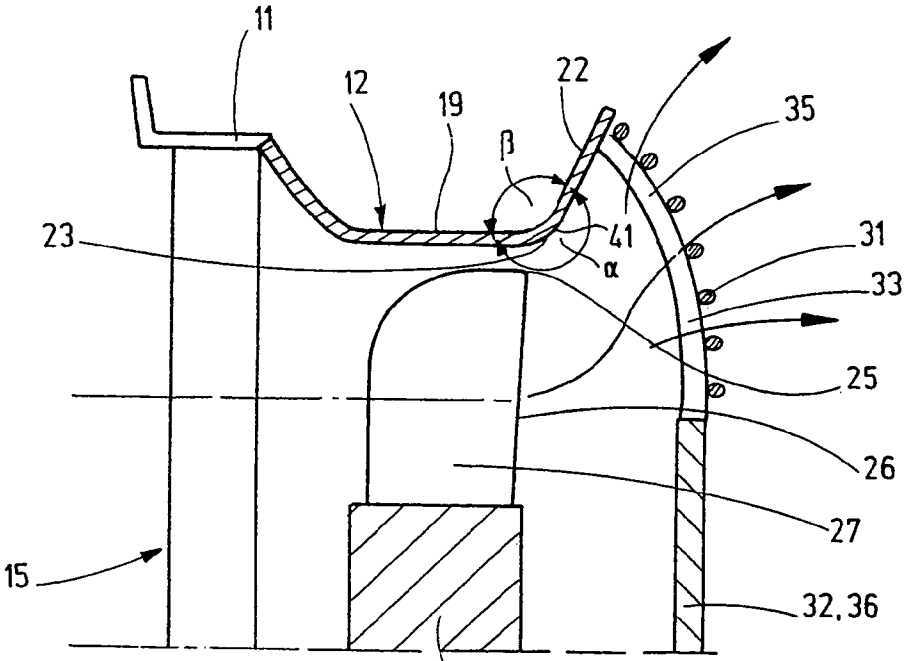
FIG. 9 is a partial sectional side view of a further embodiment of the device for the passage of air.

A further embodiment of the blast support 12 of the arrangement of the diffuser area 22 is represented in FIG. 9. The stud point 41 of the diffuser area 22 is situated in a transition 23 directly on the side wall 19. The transition is made soft as well in the outer angle $\beta$ as in the inner angle $\alpha$ in order to avoid unnecessary flow resistances. The stud point 41 is placed at the height of the tip 25 of the wing 27.

Figure 10:
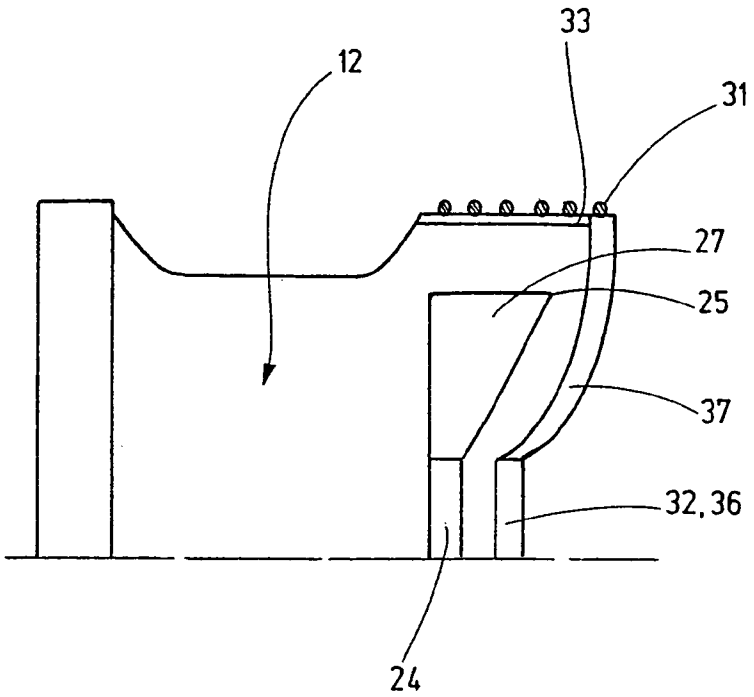
FIG. 10 is a partial sectional side view of a further embodiment of the device for the passage of air.

According to FIG. 10, the grid element 30 is configured in such a manner that it does not touch the blast 20 in case of an air direction change although the blast projects with its wings 27 over the blast support 12. On the other hand, the grid element 30 is provided again in the middle with a planar section 36. A descending area 37 which changes into the planar area 36 is provided from the outside to the planar middle section 36. Supporting webs 33 are placed laterally on which annular grid rods 31 are provided in order to make available a comprehensive protection for the blast against accidental contact.

While specific embodiments of the invention have been described in detail to illustrate the inventive principles, it will be understood that the invention may be embodied otherwise without departing from such principles.

I claim:

1. A fan filter, said fan filter configured to be fitted in a mounting opening in a wall, said fan filter comprising a blower having a rotor with blades and a motor, a basic casing, a blower support for supporting the blower, a covering device configured as a design cover, and a filter mat disposed between the basic casing and the design cover, wherein the basic casing and the design cover together enclose the filter mat entirely, wherein a grid element is placed on an air outlet side of the fan filter and is attached to an end face of the blower support, said end face being disposed on the air outlet side of the fan filter, the grid element having an ascending section and a planar section, wherein the ascending section changes into the planar section and a plate element is provided within the planar section forming a full surface section, wherein the planar section has a diameter that is smaller than a diameter of the blades of the blower, wherein the blower support has a circumferential side wall forming a recess for the blower, so that the blower is disposed inside the blower support, wherein the blower support has a section configured as a diffuser, said section forming the end face of the blower support to which the grid element is attached, wherein the section is a constituent of the side wall of the blower support, wherein a stud point of the section is placed directly on the side wall of the blower support, and the section is deflected with respect to the sidewall about an inner angle which is more than 180° and less than 270° so that the section continuously widens in a direction from the stud point to the grid element, wherein the blower and the grid element are separate components that are disposed spaced apart from each other so that the grid element does not touch the blower, wherein the grid element is not part of and not integrated into the wall in which the fan filter is fitted.

2. The fan filter according to claim 1, wherein the section is configured linear or degressively ascending.

3. The fan filter according to claim 1, wherein the section is offset with respect to the side wall to the blower middle.

4. The fan filter according to claim 1, wherein the stud point of the section is situated at the height of a rear edge or of a tip of a wing of the blower.

5. The fan filter according to claim 1, wherein the ascending section is linearly ascending.

6. The fan filter according to claim 1, wherein the planar section or the full surface section are placed in the middle above an air outlet of the fan filter.

7. The fan filter according to claim 1, wherein the full surface section is smaller than the planar section.

8. The fan filter according to claim 1, wherein the full surface section is a disk-shaped plate body set on the planar section or integrated therein.

9. The fan filter according to claim 1, wherein the planar section is placed parallel to an air outlet of the fan filter.

* * * * *